United States Patent [19]

Morawski

[11] 4,179,011

[45] Dec. 18, 1979

[54] ROOFING LADDER AND BRACES THEREFOR

[76] Inventor: Janus Morawski, P.O. Box 562, Station P, Toronto, Ontario, Canada

[21] Appl. No.: 844,358

[22] Filed: Oct. 21, 1977

[51] Int. Cl.[2] ..... E06C 1/36; E06C 7/48

[52] U.S. Cl. ..... 182/45; 182/206

[58] Field of Search ..... 182/214, 107, 108, 206, 182/45

[56] References Cited

U.S. PATENT DOCUMENTS

| | | | |
|---|---|---|---|
| 789,156 | 5/1905 | King | 182/45 |
| 799,782 | 9/1905 | Ellinger | 182/214 |
| 2,163,970 | 6/1939 | White | 182/111 |
| 2,177,677 | 10/1939 | Staben | 182/214 |
| 2,341,510 | 2/1944 | Born | 182/214 |
| 2,680,554 | 6/1954 | Dakin | 182/214 |
| 2,722,360 | 11/1955 | Malm | 182/214 |
| 2,934,163 | 4/1960 | Ladewski | 182/214 |

FOREIGN PATENT DOCUMENTS

| | | | |
|---|---|---|---|
| 1260476 | 1/1972 | United Kingdom | 182/214 |

*Primary Examiner*—Reinaldo P. Machado

[57] ABSTRACT

A ladder having an upper end brace attached to the upper end of the ladder, the upper end brace incorporating leg means adapted to extend over the ridge of the roof, and engage the pitch of the roof on the opposite sides from the ladder, thereby securing it in position without the use of further fasteners. A ladder spacer is provided towards the lower end of the ladder which is adapted to raise the ladder off the roof.

6 Claims, 3 Drawing Figures

ROOFING LADDER AND BRACES THEREFOR

The present invention relates to a roofing ladder, of the type having hollow tubular rungs and to attachments for such a ladder, for use in roofing.

BACKGROUND OF THE INVENTION

When working on a roof, it is customary to employ a ladder to climb up and down from the ground, and one or more furthur ladders are usually laid directly on the roof, to climb up and down either side of the roof. Various simple expedients are used in order to attach the further ladders in position. In some cases ladders are used on either side of the roof, and are simply tied together at the ridge. In other cases, other forms of attachment may be used. In either case, they are generally somewhat crude on the spot expedients, and are more or less dangerous or at least unsatisfactory.

In addition, in almost all cases the ladder will simply lie directly on the roof. This may well damage the roofing material such as shingles.

In addition, as a workman climbs the ladder, the rungs of the ladder will only be spaced from the roof by about a distance of one inch or less. Thus as he puts his foot on the rung the toe of his boot is almost certain to damage the roof.

In addition, it means that the ladder is somewhat hazardous to use since the workman is only able to obtain a somewhat insecure toe hold on each rung.

For all of these reasons, it is therefore desireable to have a roofing ladder which is both easier to install and secure and is less likely to damage the roof, and in particular is safer to use.

BRIEF SUMMARY OF THE INVENTION

The invention seeks to overcome the foregoing disadvantages by the provision of a ladder having an upper end brace attached to the upper end of the ladder, the upper end brace incorporating leg means adapted to extend over the ridge of the roof, and engage the pitch of the roof on the opposite side from the ladder, thereby securing it in position without the use of further fasteners. A ladder spacer is provided towards the lower end of the ladder which is adapted to raise the ladder off the roof.

In more detail, the invention comprises an upper end brace for a roofing ladder incorporating leg means attachable to the top of the ladder, and extending downwardly and outwardly therefrom at an angle, and strut means extending from said leg means in predetermined angular relationship relative to said ladder, foot means on the free end of said leg means, engageable with the roof, and fastening means on the leg means and strut means for fastening same to the ladder.

More particularly, the invention further comprises foot means pivotally mounted on said leg means whereby the ladder may be positioned on different roofs wherein the sides are arranged at different angles.

The invention further comprises pivot means connecting the strut means to the leg members so that they may be folded together when not in use.

The invention further comprises a ladder spacer consisting of side members attachable to the lower end of the ladder on either side thereof, and a foot member on said side members extending therebetween, and engageable with the roof thereby raising the lower end of the ladder above the level of the roof.

Two such ladder spacers may be used, spaced apart along the length of the ladder if required.

In both the upper end brace, and the ladder spacer, the fastening means preferably incorporates bars or plates which fit around both sides of the ladder, having holes registering with the hollow tubular rungs of the ladder.

Through bolt threaded fasteners are passed through the holes in the plates or bars, and through the hollow rungs, and provide a secure means of attachment.

The various features of novelty which characterize the invention are pointed out with particularity in the claims annexed to and formin a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF A SPECIFIC EMBODIMENT

Figure 2:
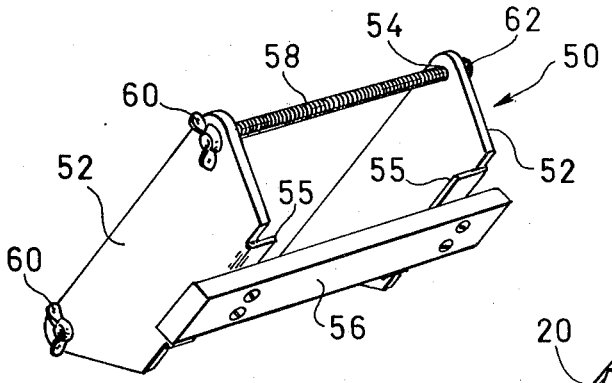
FIG. 2 is a perspective illustration of the ladder spacer according to the invention, and, FIG. 3 shows a roofing ladder, with the upper brace and ladder spacer, in use on a roof.
Figure 1:
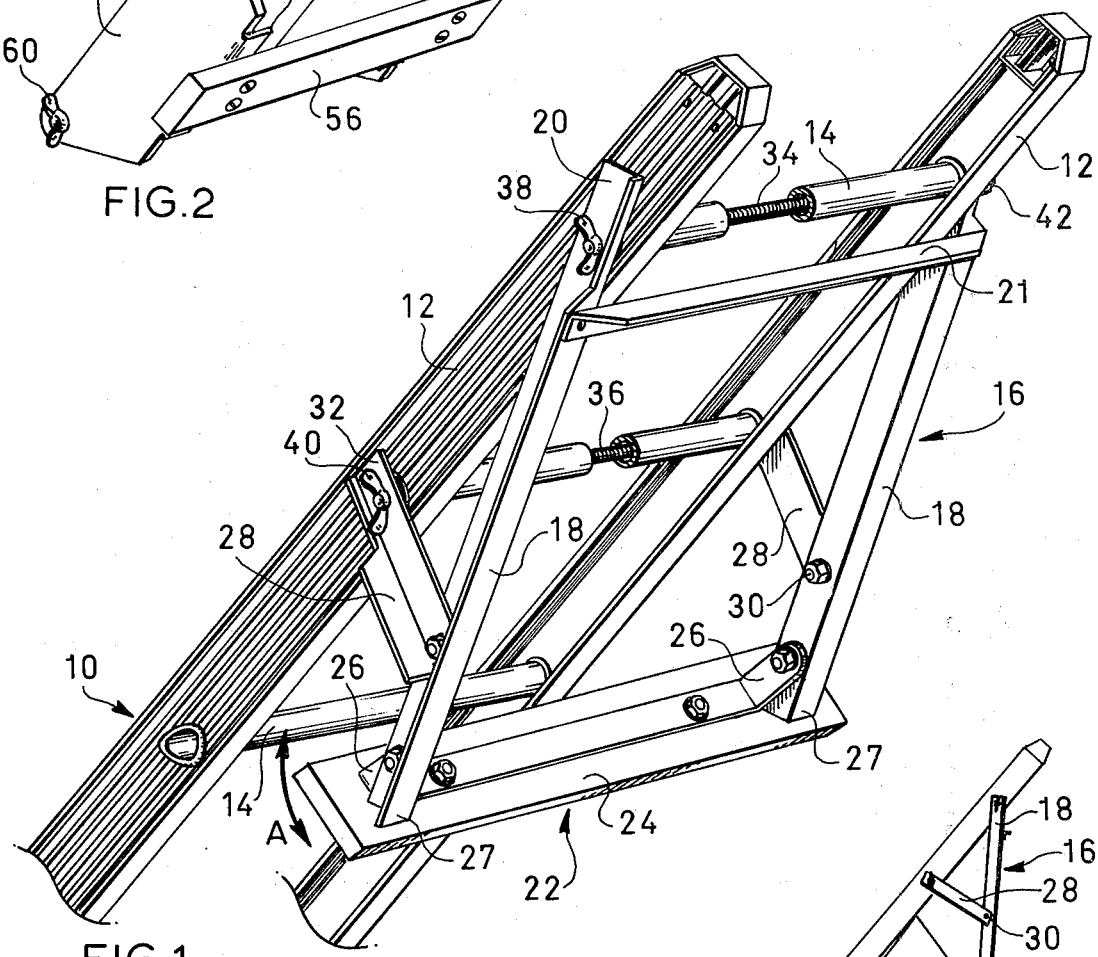
FIG. 1 is a perspective illustration of the upper end brace according to the invention.

Referring to FIG. 1, a ladder is shown partially as 10, having side members 12, and rungs 14 extending therebetween.

The ladder will usually be of the aluminum type, and the rungs 14 will be of hollow tubular construction, providing through openings extending from side to side through the ladder 10.

An upper end brace indicated generally as 16 is attached to the upper end of such ladder 10.

The brace 16 will be seen to comprise two leg members 18, of any suitable metallic material, in this case preferably being an angle section as shown, and having upper flange portions 20 formed thereon.

At the free end of the legs 18, there is provided a foot member indicated generally as 22, consisting of the cross member 24 attached by means of two arms 26, and pivotally connected to the legs 18 whereby the same may swing to and fro in the direction of the arrow A.

Stops 27 are formed on the ends of legs 18 which lock against cross member 24 and prevent it from swinging beyond a predetermined angle.

Struts 28, also preferably of any suitable metallic stock such as angle iron or angle extrusion, are pivotally attached by bolts 30 to legs 18 intermediate their two ends. When not in use the struts 28 can be simply folded flat against legs 18.

The opposite end of each strut 28 is provided with a flange 32, for attachment to the side members 12 of the ladder 10.

In order to attach the flanges 20 and 32 to the side members 12 of the ladder 10, there are provided through bolt fastening members 34 and 36, having manually operable wing nuts 38 and 40 rigidly fastened to one end thereof, and threads at their other ends.

The threaded ends of the bolts 34 and 36 are received in any suitable threaded fastening means or recesses, such as 42 and 44 formed in the opposite flanges 20 and 32 respectively. Alternatively wing nuts (not shown) can be used.

In this way, attachment of the flanges 20 and 32 may be effected simply be passing through bolts 34 and 36 through suitable openings in flanges 20 and 32, and then screwing them into the threaded fastenings 42 and 44 in the opposite flanges 20 and 32.

The upper brace 16 is then rigidly attached to the upper end of the ladder 10, with the legs 18 extending downwardly in a predetermined downwardly and outwardly angled orientation.

Figure 3:
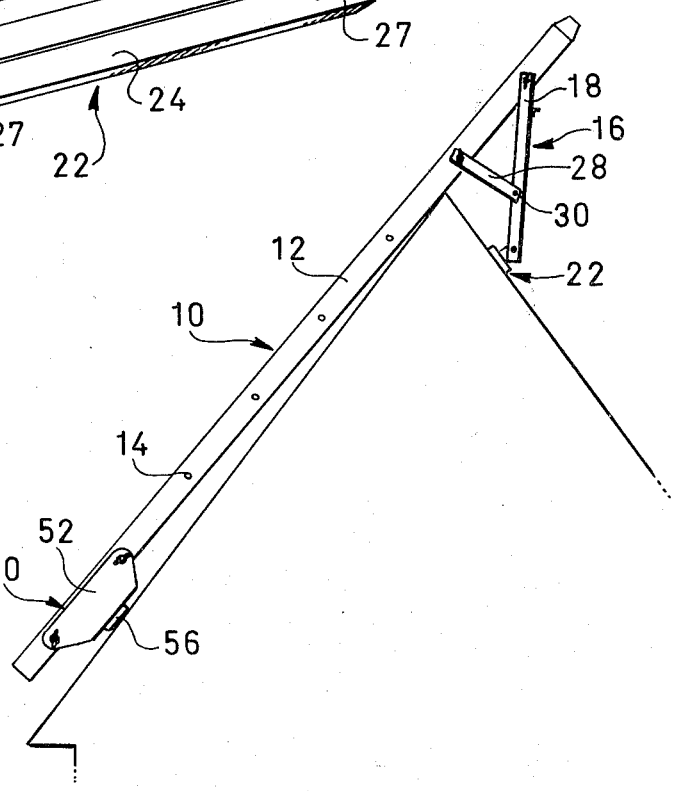

In use the ladder is placed on the roof upside down. It then an be easily slip up the roof. When the upper brace is past the ridge of the roof, the ladder is turned right side up as shown in FIG. 3 and the foot 22 will then engage the opposite side of the roof from the ladder 10, thereby securing the ladder safely so that it may be climbed by a workman.

In order to raise the end of the ladder 10 off the roof, the ladder spacer indicated generally as 50 is provided. This will be seen to comprise two side plates 52, each provided with suitable holes 54 spaced apart a distance equal to the spacing between two rungs 14 of the ladder 10.

At the downward edges of the plates 52 there are provided attachment flanges 55, and a rigid cross member 56 extending thereacross is fastened in any suitable manner to flanges 55.

Suitable through bolts 58 are provided extending through plates 52 and provided with wing nuts 60 fastened securely thereon whereby the entire body of each bolt 58 may be rotated.

The opposite one of the plates 52 is provided with any suitable threaded recess for receiving the threaded free end of the respective bolt 58, such threaded recess being shown generally as 62. Alternatively wing nuts (not shown) can be used.

Clearly, the ladder spacer 50 may simply be attached to the ladder by passing the bolts 58 through two adjacent rungs 14 and screwing them into the recess 62.

The ladder 10 will thus be raised above the roof along the major portion of its length. Clearly the upper end of the ladder will lie on the ridge of the roof as shown. In most cases however, little or no spacing or clearance is needed at this height. A workman will usually not use the last three or four rungs of the ladder, because he has no need to. A workman can safely climb up and down most of the length of the ladder, with the rungs well clear of the roof. He will then have a secure foot-hold on the rungs without the toes of his boots damaging the shingles on the roof.

If spacing is required along the full length of the ladder, then a second ladder support 50 (not shown), can simply be attached towards the upper end of the ladder. Conceivably two such spacers can be used without an upper end brace at all.

For example it may be desireable to attach a ladder more or less permanently to eg. a vertical wall. The use of two spacers would then provide the answer.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. Roofing ladder attachment means for a ladder of the type having hollow tubular rungs, said attachment means comprising;

an upper end brace for use on such a ladder and having leg means attachable to the upper end of the ladder, with its free end extending outwardly and downwardly, and strut means attachable to another point on the ladder, and connected with the leg means to secure the same in its angular relations to the ladder;

releaseable fastening means for securing the leg means, and the strut means to the ladder;

foot means on the leg means for lying on the roof and holding the ladder, and, a ladder spacer attachable to said ladder spaced apart from said upper end brace, and having ladder connection means attachable in predetermined location on said ladder, and foot means on said connection means spaced downwardly from said ladder and adapted to lie on a said roof thereby raising said ladder off said roof, and wherein said ladder connection means comprises a pair of plate members spaced apart so as to register with two separate rungs of said ladder and further said fastening means extending through said holes and respective said rungs.

2. Roofing ladder attachment means as claimed in claim 1, wherein the leg means comprise a pair of leg members, flanges at one end of said leg members, spaced apart of fit around opposite sides of a said ladder, and holes in said flanges for registering at opposite ends of a said rung of said ladder, and said fastening means extending through said holes and said rung.

3. Roofing ladder attachment means as claimed in claim 2, including pivot means connecting said leg members and said strut means whereby they may be folded together when not attached to the ladder.

4. Roofing ladder attachment means as claimed in claim 1 wherein said fastening means comprise bolt members, manually operable head means on one end thereof, threads on the other end thereof, and cooperative threads on one of said plate members.

5. Roofing ladder attachment means as claimed in claim 1 including flanges on said strut means and holes therein adapted to register with opposite ends of another said rung, and wherein said fastening means comprise bolt members insertable through said holes and completely through respective said rungs, and cooperative threads on one of each pair of flanges for receiving said bolt means.

6. Roofing ladder attachment means as claimed in claim 1 including;

swinging connection means connecting said foot means to said leg means, whereby the same may swing inwardly and outwardly towards and away from said ladder, and, stop means on said leg means, for limiting outward swinging of said foot means, whereby when the upper end brace is clear of the ridge of the roof, the foot means may swing to accommodate the slope of the roof, within the limits of the stop means, thereby ensuring that the foot means lies on the roof surface and avoiding damage to the roof.

* * * * *